US006679788B1

(12) United States Patent
Heinrich et al.

(10) Patent No.: US 6,679,788 B1
(45) Date of Patent: Jan. 20, 2004

(54) GOLF CLUB WITH STRESS-SPECIFIC STRIKING FACE AND METHOD OF PRODUCING THE COATING

(75) Inventors: Peter Heinrich, Germering (DE); Heinrich Kreye, Hamburg (DE)

(73) Assignee: Linde Gas Aktiengesellschaft, Hoellriegelskreuth (DE)

( * ) Notice: Subject to any disclaimer, the term of this patent is extended or adjusted under 35 U.S.C. 154(b) by 103 days.

(21) Appl. No.: 09/603,911

(22) Filed: Jun. 26, 2000

(30) Foreign Application Priority Data

Jun. 24, 1999 (DE) ..... 199 29 116

(51) Int. Cl.[7] ..... A63B 53/04
(52) U.S. Cl. ..... 473/324; 473/330
(58) Field of Search ..... 473/324, 329, 473/330, 335, 342, 348, 349

(56) References Cited

U.S. PATENT DOCUMENTS

| | | | | |
|---|---|---|---|---|
| 4,416,421 A | | 11/1983 | Browning | |
| 5,272,802 A | | 12/1993 | Stites, III | 29/527.2 |
| 5,302,414 A | | 4/1994 | Alkhimov et al. | 427/192 |
| 5,531,444 A | | 7/1996 | Buettner | 473/349 |
| 5,851,158 A | * | 12/1998 | Winrow et al. | |
| 6,059,670 A | * | 5/2000 | Mogan | |

FOREIGN PATENT DOCUMENTS

| | | |
|---|---|---|
| EP | 0 484 533 | 5/1992 |
| EP | 0 925 810 | 6/1999 |
| JP | 10-230028 | 9/1998 |
| JP | 11-4920 | 1/1999 |
| WO | WO 97/20961 | 6/1997 |

OTHER PUBLICATIONS

Copy of Specification of patent application Ser. No. 09/217,820 filed on Dec. 22, 1998.

H. Kreye et al., "High Velocity Oxy–Fuel Flame Spraying–Process and Coating Characteristics", Thermal Spray: Practical Solutions for Engineering Problems, C. C. Berndt (Ed.), ASM International, Materials Park, Ohio, 1996, pp. 451–456.

Norbert Wagner et al., "Particle Velocity in Hypersonic Flame Spraying of WC–Co", Surface Technology, 22, 1984, pp. 61–71.

Kreye, "High Velocity Flame Spraying—Process and Coating Characteristics", Proceedings, 2nd Plasma–Technik–Symposium (vol. 1), pp. 39–47, Jun. 5–7, 1991.

* cited by examiner

*Primary Examiner*—Paul T. Sewell
*Assistant Examiner*—Nini F. Legesse
(74) *Attorney, Agent, or Firm*—Crowell & Moring LLP

(57) ABSTRACT

In order to increase the useful life of a golf club, at least part of the golf club in a region of the striking face is coated with a coating that is neutral in terms of stress or has compressive stresses. The coating is applied by a thermal spraying method with average spray-particle velocities of over 500 m/s. The coating preferably has compressive stresses of between 0 and 600 MPa.

13 Claims, 1 Drawing Sheet

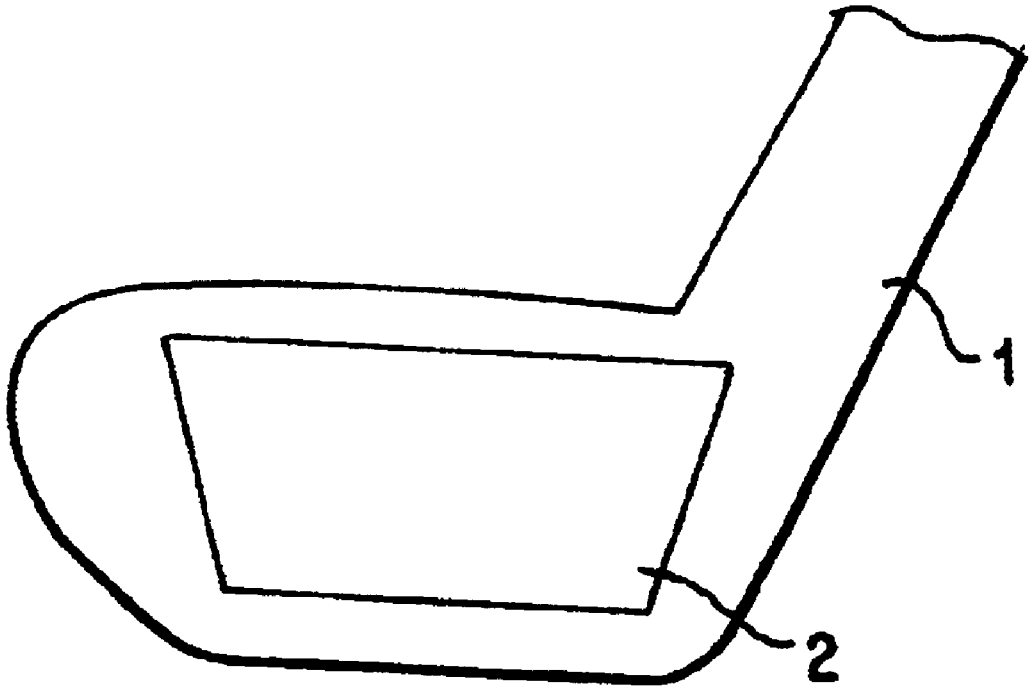
1
2

GOLF CLUB WITH STRESS-SPECIFIC STRIKING FACE AND METHOD OF PRODUCING THE COATING

BACKGROUND AND SUMMARY OF INVENTION

This application claims the priority of German patent document 199 29 116.0, filed Jun. 24, 1999, the disclosure of which is expressly incorporated by reference herein.

The present invention relates to a golf club with a striking face for striking golf balls. Furthermore, the present invention relates to a method of coating a golf club, at least in the region of the striking face, by a thermal spraying method.

WO 97/20961 discloses the coating of striking faces of golf clubs after previous texturing by flame spraying or by plasma spraying. The coating may consist of metal-bonded carbides (cermets) or oxides (ceramic compounds). The coating in this publication is characterized as hard, of homogenous construction, wear-resistant, and provided with a rough surface. In coatings produced in this way, however, crack formations may occur, which limits the useful life or the lifespan of the coated striking face.

U.S. Pat. No. 5,272,802 describes a design modification of conventional golf clubs, in which thermal spraying is mentioned as a method of incorporating weight elements on the back of the golf club. The weight elements merely vary the moment of inertia of the golf club. A thermally sprayed functional coating of a striking face is not described.

The object of the present invention is therefore to provide a golf club and a method of making the golf club which enable the useful life of the coatings on striking faces of golf clubs to be increased.

This object is achieved according to the present invention in that the golf club, in the region of the striking face, at least partly comprises a coating that is either designed to be neutral in terms of stress or has compressive stresses.

It has been found that the prior art coatings for striking faces of golf clubs have inherent tensile stresses, which have an adverse effect on the period of use and the useful life. According to the present invention, inherent tensile stresses are therefore avoided in the coating of the striking face. On the contrary, stress neutrality or preferably compressive stresses in the coating are proposed. Compressive stresses mean that the cohesion of the particles in the coating is improved and the material does not tend to form cracks quickly during alternating loading.

Coatings which are neutral in terms of stress or coatings with compressive stresses can be produced by the coating being applied by a thermal spraying method with average spray-particle velocities of over 500 m/s.

BRIEF DESCRIPTION OF THE DRAWING

The sole FIGURE shows a schematic diagram of a golf club according to the present invention.

DETAILED DESCRIPTION OF THE INVENTION

Thermal spraying methods are essentially characterized by the fact that they permit uniformly applied coatings of high quality. Coatings applied by thermal spraying methods can be adapted to different requirements by varying the spray materials and/or the parameters of the spraying method. In this case, the spray materials may in principle be the form of wires, rods, or a powder. A subsequent treatment may also be provided.

In thermal spraying coating methods, basically oxyfuel flame spraying or high-velocity flame spraying; arc spraying; plasma spraying; detonation spraying; and laser spraying are known as variants.

In addition, a further thermal spraying method which is designated as cold-gas spraying has recently been developed. This spraying method is a type of high-velocity flame spraying. It is described, for example, in European Patent EP 0 484 533 B1. An additional material in powder form is used in cold-gas spraying. However, the powder particles are not melted in the gas jet in the case of cold-gas spraying. On the contrary, the temperature of the gas jet is below the melting point of the additional material powder particles. A "cold" gas compared with the conventional spraying methods or a comparatively colder gas is therefore used in the cold-gas spraying method. The gas is nonetheless heated in the same way as in the conventional methods, but as a rule merely to temperatures below the melting point of the powder particles of the additional material. In cold-gas spraying, the powder particles can be accelerated to a velocity of 300 to 1600 m/s.

In high-velocity flame spraying or also HVOF spraying (high velocity oxygen fuel), different generations of the methods are distinguished. High-velocity flame spraying of the first generation and high-velocity flame spraying of the second generation have average spray-particle velocities of between 400 and 450 m/s. Since 1992 or 1994, high-velocity flame spraying of the third generation have average spray-particle velocities of over 500 m/s.

High-velocity flame spraying of the third generation with average spray-particle velocities of over 500 m/s is thus suitable for the present invention. Those systems of the third generation of high-velocity flame spraying with which the requisite velocities can be achieved are known, for example, under the designations JP 5000, DJ 2600, DJ 2700, Top Gun K, and OSU Carbide Jet System. Cold-gas spraying is also advantageous for some applications.

For the coating of the golf clubs by thermal spraying, carbides; cermets (metal-bonded carbides such as WC-Co, WC-CoCr, $Cr_3C_2$-NiCr and the like); oxides (in particular $Al_2O_3$ and/or $TiO_2$); or mixtures of these materials may be used as spray materials. Preferably, carbides and/or cermets are used.

Powders having particle sizes of 1 $\mu$m to 1 mm, preferably 5 to 100 $\mu$m, are suitable for producing the golf clubs by the thermal spraying methods.

According to the present invention, average spray-particle velocities of at least 500 m/s upon impact of the particles are proposed for coating a golf 1 by thermal spraying, as shown in the FIGURE. The coating 2 is advantageously applied at average spraying-particle velocities of over 550 m/s, preferably over 600 m/s, and in particular preferably between 600 and 700 m/s. The higher particle velocities ensure that the shrinkage associated with the solidification of the material on the substrate and the resulting tensile stresses are overcompensated for by the jet effect of the particles striking with high kinetic energy.

According to the present invention, the coating has compressive stresses of between 0 and 600 MPa, preferably between 50 and 550 MPa. Compressive stresses within these ranges can easily be produced with the systems of the third generation of the high-velocity flame spraying equipment.

In an embodiment of the present invention, the coatings have a hardness of over 1250 HV 0.3, preferably over 1300 HV 0.3. This increased hardness can be achieved by utilizing systems of the third generation of high-velocity flame spraying. This is because coatings produced with these systems as a rule have a hardness of about 1300 to 1400 HV 0.3. Coatings produced with systems of the third generation are thus harder than coatings produced by the second or first generation of high-velocity flame spraying or by plasma spraying, the hardness of which coatings is about 200 HV lower.

The coatings according to the present invention, which are produced with higher average spray-particle velocities, have a lower proportion of pores and thus a further advantage, i.e., a higher modulus of elasticity. When executing a shot with the golf club, less energy is therefore absorbed in the head of the golf club.

All the gases known for the thermal spraying method are suitable.

In a development of the present invention, the coating has an amorphous and/or nanocrystalline atomic structure. This structure is especially advantageous for long drives.

In order to obtain an amorphous state in a material, the material must be cooled down extremely quickly from the molten mass. According to the present invention, during the coating by high-velocity flame spraying with fusion of the spray particles, upon impact from the molten mass, the spray particles are cooled down at a cooling rate of between $10^4$ K/s and $10^5$ K/s.

The rapid cooling is recommended in particular in connection with a coating comprising an alloy of transition metals (e. g., Fe, Ni, Co, Mn) and metalloids (e. g., B, C, Si, P). In this case, the coating preferably comprises 70 to 90 atomic % transition metals and 30 to 10 atomic % metalloids. A material which meets this specification is the self-flowing nickel alloy of type 60 (Rockwell harness 60 HRC) having the following composition (guide analysis in percentage by weight):

Cr 13.5 to 17.5%;

Si 4.25 to 4.5%;

B 3.0 to 3.5%;

Fe 4.0 to 4.75%;

C 0.1 to 1.0%; and

Ni remainder.

However, the amorphous state occurring during rapid cooling is thermodynamically stable only up to a temperature of 300 to 400° C. During spraying, therefore, excessive heating of the coating surface by the flame and accompanying crystallization should be avoided. In connection with the aforesaid NiCrBSi alloy and the production of an amorphous coating by high-velocity flame spraying, reference is made to H. Kreye, High Velocity Flame Spraying - Process and Coating Characteristics, Proceedings of the $2^{nd}$ Plasma Technology Symposium, Lucerne, Vol. 1, pages 39–47 (1991).

For the execution of gentle shots, coatings in which energy is absorbed in the club are recommended. Suitable for this purpose are metallic coatings which are not hardened by oxide formation in the spray process. An oxide formation and associated hardening of the coating should therefore be avoided. Such coatings can be produced by high-velocity flame spraying with fusion of the spray particles or by cold-gas spraying.

Conversely, with regard to firm shots, the coating can be hardened by oxide formation in particular during high-velocity flame spraying with fusion of the spray particles.

In addition to being applied to the conventional parent materials for heads of golf clubs, the thermally sprayed coating may also be applied to parent materials of aluminum or aluminum alloys, plastics, in particular carbon-fibre-reinforced plastics, and/or graphite.

With the present invention, special properties can be achieved by varying the parameters of the coating or of the thermal spraying method, for example:

Increase in the friction factor on the striking face, for example, in order to give the golf ball a more efficient spin. In addition, it is also possible to minimize the spread of the shots. Carbide coatings are especially suitable.

The striking energy can be optimally transmitted to the ball. From the material point of view, this is assisted, for example, by the titanium often used in golf clubs.

Sensitive initiation of the strike of the ball, e.g., when holing out, can be achieved. In this case, soft material is appropriate.

The wear resistance of the golf club can be increased, for example when using the sand wedge from the bunker.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A golf club with a striking face for striking golf balls comprising, at least partly in a region of the striking face, a coating that has compressive stress, wherein the coating is applied by a thermal spraying method with an average spray-particle velocity of over 500 m/s, and wherein the coating has a compressive stress between 0 and 600 Mpa, and wherein the coating comprises an alloy of transition metals and metalloids with 70 to 90 atomic % transition metals and 30 to 10 atomic % metalloids.

2. A golf club according to claim 1, wherein the coating comprises at least one of carbides, cermets, or oxides.

3. A golf club according to claim 1, wherein the coating has a compressive stress between 50 and 550 MPa.

4. A golf club according to claim 1, wherein the coating has a hardness of over 1250 HV 0.3.

5. A golf club according to claim 4, wherein the coating has a hardness of over 1300 HV 0.3.

6. A golf club according to claim 1, wherein the coating has an amorphous or nanocrystalline atomic structure.

7. A golf club according to claim 1, wherein the coating is a metallic coating hardened by oxide formation or applied while avoiding hardening by oxide formation.

8. A golf club according to claim 1, wherein the thermally sprayed coating is applied to at least one material selected from the group consisting of aluminum, aluminum alloys, plastics, and graphite.

9. A golf club according to claim 8, wherein the at least one material is a carbon-fiber-reinforced plastic.

10. A golf club according to claim 1, wherein the coating comprises WC-Co or WC-CoCr.

11. A golf club according to claim 1, wherein the coating comprises $Cr_3C_2$-NiCr.

12. A golf club according to claim 1, wherein the coating comprises $TiO_2$ or $Al_2O_3$.

13. A golf club according to claim 1, wherein the coating comprises a nickel alloy.

* * * * *